US011253975B2

(12) United States Patent
Liu

(10) Patent No.: US 11,253,975 B2
(45) Date of Patent: Feb. 22, 2022

(54) CLAMP

(71) Applicant: Sung-Chi Liu, Taichung (TW)

(72) Inventor: Sung-Chi Liu, Taichung (TW)

( * ) Notice: Subject to any disclaimer, the term of this patent is extended or adjusted under 35 U.S.C. 154(b) by 179 days.

(21) Appl. No.: 16/522,642

(22) Filed: Jul. 25, 2019

(65) Prior Publication Data

US 2020/0030942 A1 Jan. 30, 2020

(30) Foreign Application Priority Data

Jul. 27, 2018 (TW) ..... 107126139

(51) Int. Cl.

| | |
|---|---|
| ***B25B 5/04*** | (2006.01) |
| ***B25B 5/06*** | (2006.01) |
| ***B25B 7/02*** | (2006.01) |
| ***B25B 7/14*** | (2006.01) |

(52) U.S. Cl.

CPC ..... *B25B 5/04* (2013.01); *B25B 7/02* (2013.01); *B25B 7/14* (2013.01); *B25B 5/06* (2013.01)

(58) Field of Classification Search

CPC .. B25B 5/166; B25B 5/04; B25B 5/16; B25B 7/14; B25B 7/04; B25B 7/18; B25B 7/08; B25B 7/16; B25B 5/00; B25B 3/00

USPC ..... 269/6, 148, 143, 248; 81/319

See application file for complete search history.

(56) References Cited

U.S. PATENT DOCUMENTS

| | | | | |
|---|---|---|---|---|
| 5,595,375 | A * | 1/1997 | Bennhausen | B25B 5/04 269/229 |
| 6,212,977 | B1 * | 4/2001 | Liou | B25B 5/06 269/166 |
| 8,286,954 | B2 * | 10/2012 | Zheng | B25B 5/06 269/188 |
| 9,120,207 | B2 * | 9/2015 | Chang | B25B 7/18 |
| 9,527,191 | B2 * | 12/2016 | Chen | B25B 7/14 |
| 2003/0029281 | A1 * | 2/2003 | Yu | B25B 7/14 81/385 |
| 2006/0208407 | A1 * | 9/2006 | Wang | B25B 5/06 269/6 |
| 2010/0314816 | A1 * | 12/2010 | Yang | B25B 7/14 269/214 |

* cited by examiner

*Primary Examiner* — Seahee Hong

(57) ABSTRACT

A clamp has: a clamping set and a positioning set. The clamping set has a shaft pivotally connected to a first arm and a second arm, and the shaft is provided with an elastic member. The first arm and the second arm are kept open by the elastic member, and the first and second arms are extended downward with a first handle and a second handle. The first handle is provided with a first pin, and the second handle is provided with a second pin. The positioning set is pivoted on a middle section of the first and second handles with the first and second pins. The positioning set is approximately horizontal, and travel distance of the shaft is greatly reduced, which not only reduces the structural cost, but also effectively improves the smoothness of the shaft movement.

7 Claims, 15 Drawing Sheets

CLAMP

BACKGROUND OF INVENTION

Field of Invention

The present invention relates to a clamp, and more particularly to a quick-release clamp.

Description of the Related Art

Accordingly, in a conventional clamp structure, as shown in FIG. 15, the positioning set 40 is bolted to the handles 311, 321 of the clamping set 30 at an oblique angle, so the shaft 41 of the positioning set 40 has a long travel distance, resulting in an increase in structural cost and affecting the smoothness of the actuation. On the other hand, because of the tilting arrangement of the positioning set 40, the cutting handle 43 is disposed along the base 42 between the two handles 311, 322, causing the cutting handle 43 can be touched by mistake easily to disengage the positioning set 40, and resulting the first and second arms 31, 32 of the clamping set 30 to lose the grip state and injury. In addition, it is difficult to directly operate the clamping set 30 by pressing with one hand, and it is necessary to use both hands to actually achieve the clamping and releasing operations.

Therefore, it is desirable to provide a clamp to mitigate and/or obviate the aforementioned problems.

SUMMARY OF THE INVENTION

An objective of present invention is to provide a clamp, which is capable of improving the above-mention problems.

In order to achieve the above mentioned objective, a clamp has a clamping set having a first arm and a second arm pivoted together via a shaft, the shaft jacketed with an elastic member to push the first arm and the second arm apart, the first and second arms respectively having a first handle and a second handle, the first handle provided with a first pin, the second handle provided with a second pin; and a positioning set having a main body, a shaft, a baffle, a press lever and a control rod, the main body provided with a shaft slot and a through slot below the shaft slot, the main body further having a limiting portion facing the shaft slot and two opposing conical concave surfaces, a recess disposed between the two conical concave surfaces on the main body and connected to the through slot; the through slot provided with a first limiting opening at a front end for accepting a first elastic member and an assembly aperture at a rear end, the assembly aperture accepting the first pin engaged with the first handle; the shaft disposed through the shaft slot of the main body and having an engaging aperture accepting the second pin engaged with the second handle; the baffle having an axial aperture, an accepting aperture below the axial aperture, and an engaging portion above the axial aperture, the axial aperture of the baffle jacketing onto the shaft, the engaging portion and the limiting portion of the main body locked with each other, the accepting aperture facing the first limiting opening and the first elastic member; the press lever having two parallel arms and a connecting portion between the two arms, the two arms rotatably pivoted on the two conical concave surfaces of the main body, and the connecting portion disposed in the recess; the control rod disposed in through slot and the first limiting opening, one end of the control rod passing through the recess and engaged with the connecting portion of the press lever, and another end of the control rod passing through the first limiting opening and connected to the accepting aperture of the baffle, such that the control rod drives the press lever and the baffle and pushes the baffle towards the first elastic member.

Other objects, advantages, and novel features of invention will become more apparent from the following detailed description when taken in conjunction with the accompanying drawings.

DETAILED DESCRIPTION OF THE PREFERRED EMBODIMENT

Figure 1:
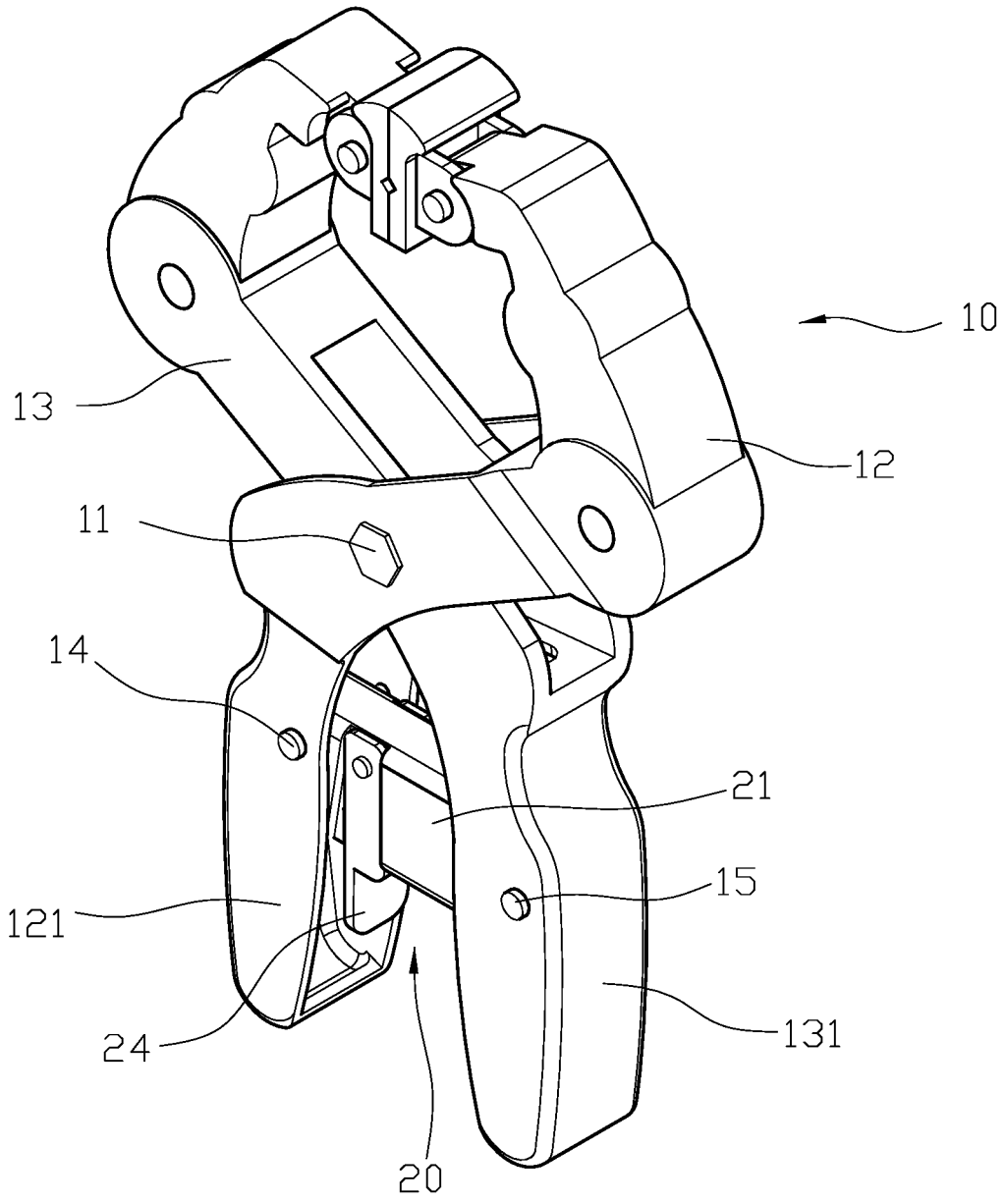
FIG. 1 is a perspective view of a preferred embodiment of the present invention.
Figure 2:
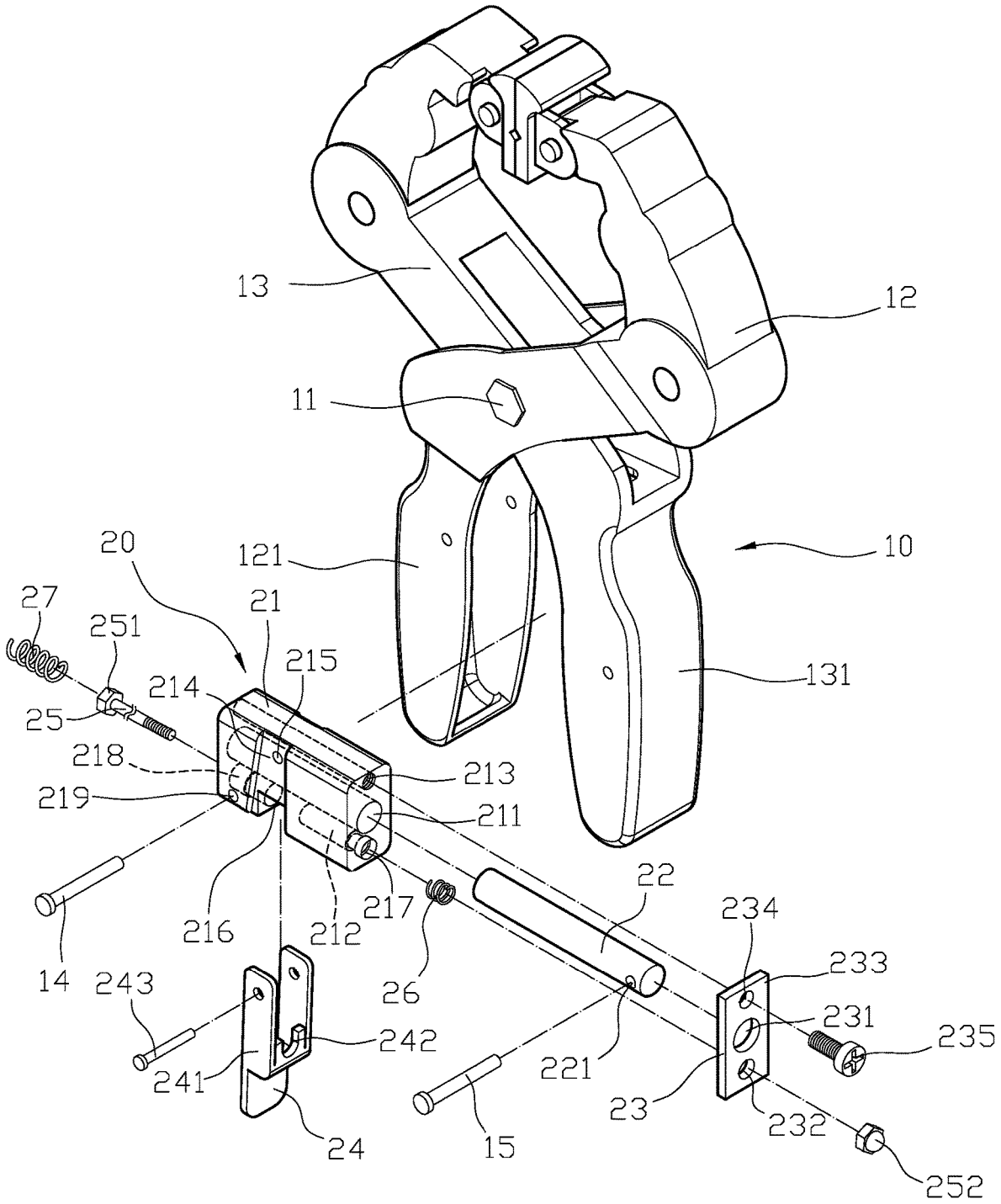
FIG. 2 is an exploded view of the preferred embodiment of the present invention.
Figure 3:
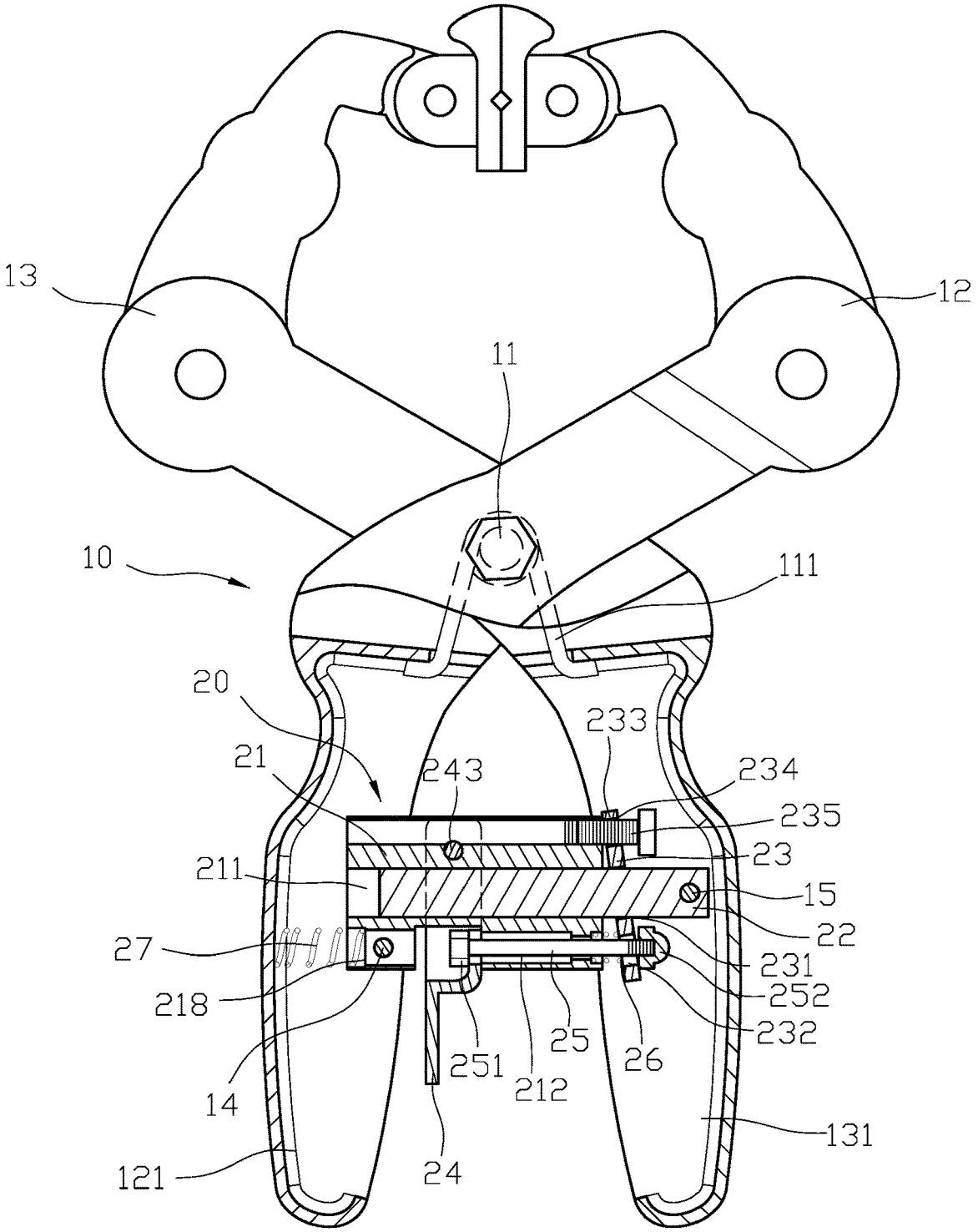
FIG. 3 is a cross-sectional view of the combination of the preferred embodiment of the present invention.

First, please refer to FIGS. 1, 2 and 3. A quick-release clamping set comprises a clamping set 10 and a positioning set 20. The clamping set 10 has a first arm 12 and a second arm 13 pivoted together via a shaft 11, and the shaft 11 is jacketed with an elastic member 111 to push the first arm 12 and the second arm 13 apart. The first and second arms 12, 13 respectively has a first handle 121 and a second handle 131, the first handle 121 is provided with a first pin 14, and the second handle 131 is provided with a second pin 15. The positioning set 20 has a main body 21, a shaft 22, a baffle 23, a press lever 24 and a control rod 25. The main body 21 is further provided with a shaft slot 211 and a through slot 212 below the shaft slot 211. The main body 21 further has a limiting portion 213 facing the shaft slot 211, and the limiting portion 213 is a screw hole. Furthermore, the main body 21 has two opposing conical concave surfaces 214 on its two sides which are connected with a positioning aperture 215, and a recess 216 disposed between the two conical concave surfaces 214. The recess 216 is connected to the through slot 212. The through slot 212 is provided with a first limiting opening 217 at a front end for accepting a first elastic member 26. A rear end of the through slot 212 is provided with a second limiting opening 218 for accepting a second elastic member 27. An assembly aperture 219 at the rear end of the through slot 212 and through the second limiting opening 218, and the assembly aperture 219 accepts the first pin 14 engaged with the first handle 121. The shaft 22 is disposed through the shaft slot 211 of the main body 21 and has an engaging aperture 221 accepting the second pin 15 engaged with the second handle 131. The baffle 23 has an axial aperture 231, an accepting aperture 232 below the axial aperture 231 and an engaging portion 233 above the axial aperture 231. The axial aperture 231 of the baffle 23 jackets onto the shaft 22, and the engaging portion 233 has a limiting aperture 234 corresponding to the screw hole of the limiting portion 213, and a bolt 235 is disposed through the limiting aperture 234 and locked with the limiting portion 233 to push the baffle 23. The accepting aperture 232 faces the first limiting opening 217 and the first elastic member 26. The press lever 24 has two parallel the arms 241 and a connecting portion 242 between the two arms 241. The two arms 241 are rotatably pivoted on the two conical concave surfaces 241 of the main body with an axial pin 243 through the positioning aperture 215, and the connecting portion 242 is disposed in the recess 216. The control rod 25 is disposed in through slot 212 between the first limiting opening 217, one end 251 of the control rod 25 passes through the recess 216 and is engaged with the connecting portion 242 of the press lever 24, and another end of the control rod 25 passes through the first limiting opening 217 and is connected to the accepting aperture 232 of the baffle 23 with a nut 252, such that the control rod 25 drives the press lever 24 and the baffle 23 and pushes the baffle 23 towards the first elastic member 26.

Figure 4:
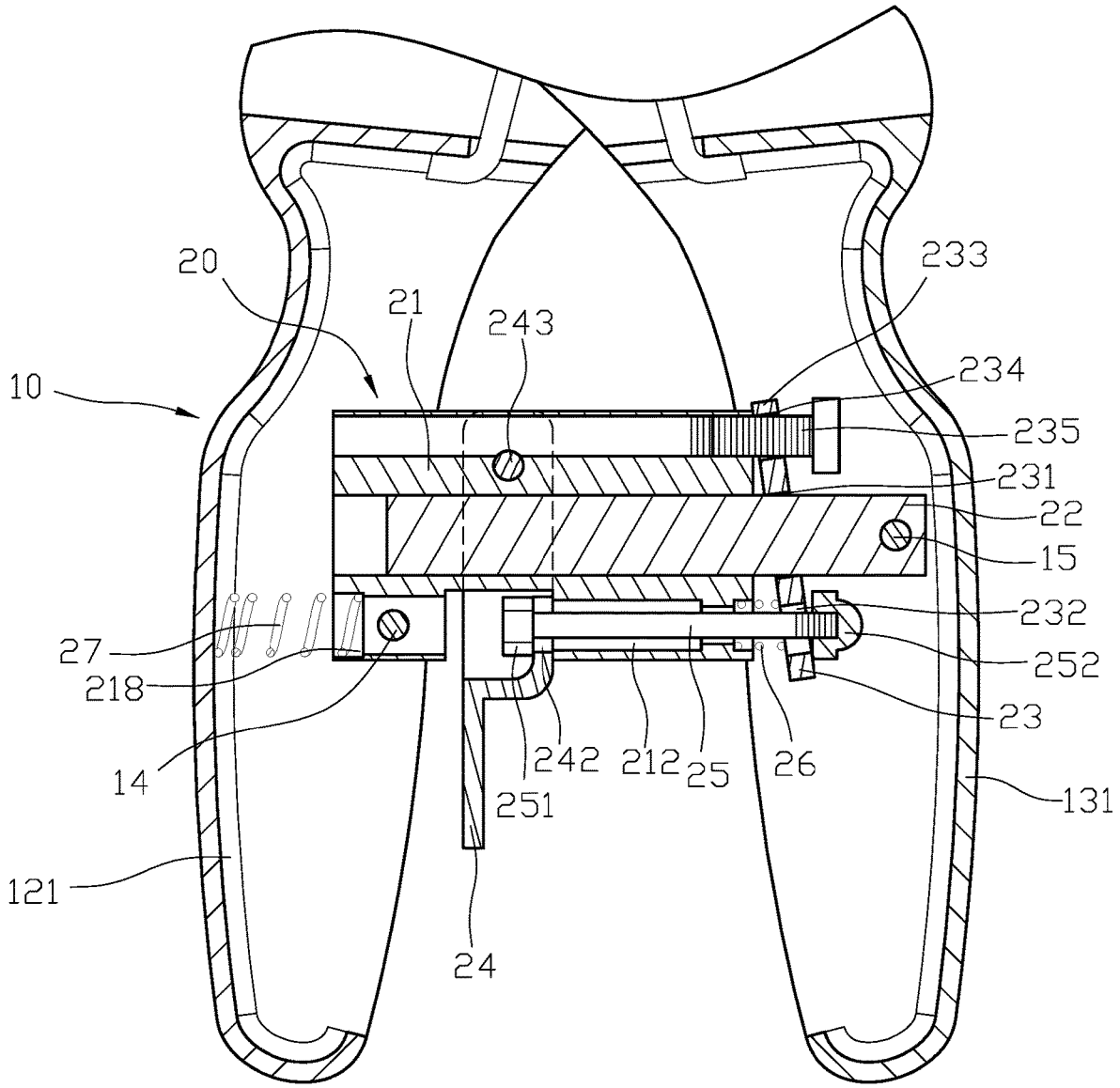
FIG. 4 is an enlarged cross-sectional view of the combination of the preferred embodiment of the present invention.

The composition of the structure, see also FIGS. 2, 3, and 4. In order to assemble the positioning set 20, the shaft 22 is disposed into the shaft slot 211 of the main body 21, the axial aperture 231 of the baffle 23 jackets over the shaft 22, and the limiting portion 213 of the main body 21 faces the limiting aperture 234 of the engaging portion 233 of the baffle 23, and the baffle 23 is locked to the limiting aperture 234 by a bolt 235. The accepting aperture 232 faces the through slot 212 of the main body 21, the first limiting opening 217 at the front end of the slot 212 is installed with the first elastic member 26, the two arms 241 of the press lever 24 respectively cover on the conical concave surface 214 of the main body 21 and are bolted to the positioning aperture 215 of the main body 21 through the axial pins 243, so that the press lever 24 can be rotated around the axial pin 243. The control rod 25 is placed through the through slot 212 and the first limiting opening 217, one end of the control rod 25 passes through the first limiting opening 217 and the first elastic member 26 and the accepting aperture 232 of the baffle 23 and then the nut 252 is assembled with the baffle 23 to secure; the other end 251 of the control rod 25 is linked to the connecting portion 242 of the press lever 24 to drive the baffle 23 towards to the main body 21. Finally, the assembly aperture 219 of the main body 21 is pivoted onto the first handle 121 by the first pin 14, and the second limiting opening 218 of the through slot 212 is further provided with the second elastic member 27 pushing against the inside of the first handle 121, and the engaging aperture 221 of the shaft 22 is pivoted onto the second handle 131 via the second pin 15 to horizontally mount the positioning set 20 between the first and the second grip 121 of the clamping set 10, to complete a quick release clamping set.

The actual use of the structure, continued as shown in FIGS. 3 and 4. When the first and second arms 12, 13 of the clamping set 10 are closed, due to the engagement of the engaging portion 233 and the bolt 235, the baffle 23 of the positioning set 20 is close to the main body 21, the accepting aperture 232 at the lower end of the baffle 23 is kept away from the main body 21 by the first elastic member 26, thereby the baffle 23 is inclined and the axial aperture 231 of the baffle 23 clamps the shaft 22 due to the tilting state, so that the shaft 22 cannot be pulled out and is limited in the shaft slot 211 of the main body 21 to prevent the elastic member 111 of the clamping set 10 elastically from opening the first and second arms 12, 13, to achieve the closed positioning of the first and second arms 12, 13.

Figure 5:
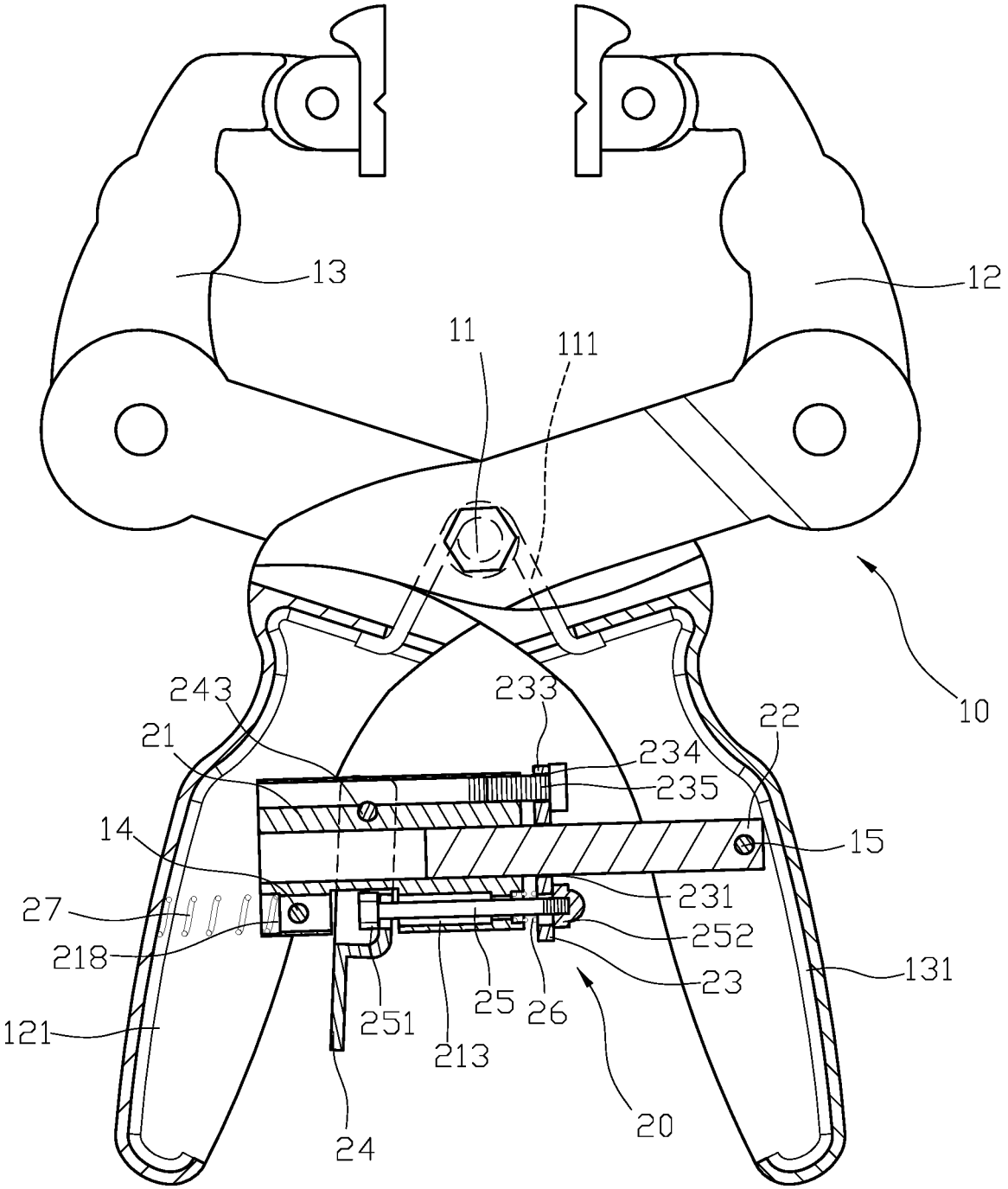
FIG. 5 is a schematic view showing the expanded state of the preferred embodiment of the present invention.
Figure 6:
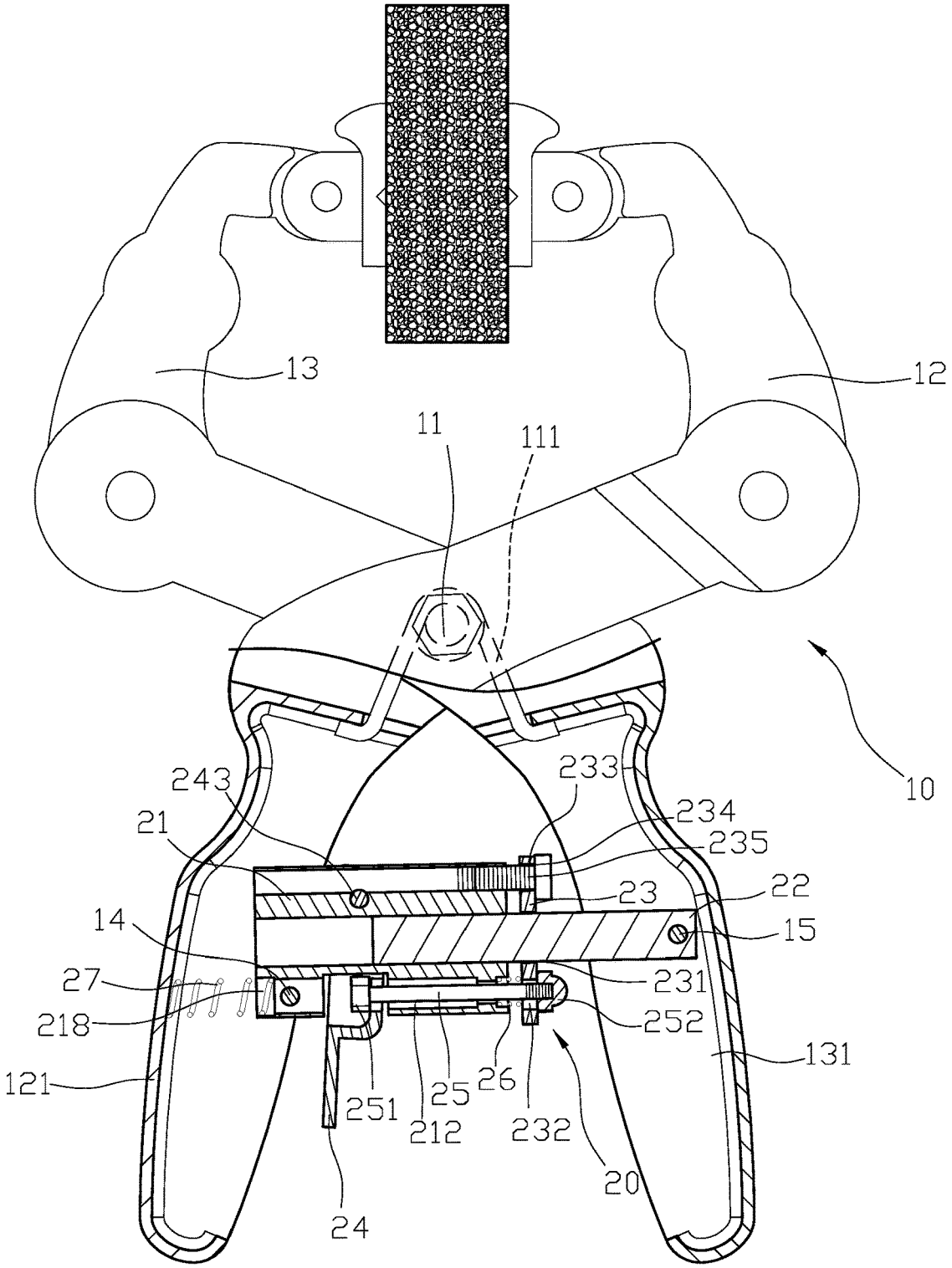
FIG. 6 is a schematic view showing the state of the closing of the preferred embodiment of the present invention.

In order to open the first and second arms 12, 13 of the clamping set 10, refer to FIGS. 5 and 6, by pressing the press lever 24, the control rod 25 drives the lower end of the baffle 23 to move closer to the main body 21 and compress the first elastic member 26, thereby causing the axial aperture 231 of the baffle 23 to slightly loosen the shaft 22 out of the axial aperture 231 to open the first and second arms 12, 13 of the clamping set 10. When pressing the first and second handles 121, 131 of the clamping set 10 to operate the first and second arms 12, 13 for clamping, since the press lever 24 has been loosened, the lower end of the baffle 23 immediately subjected by the first elastic member 26 to push away from the main body 21, and the engaging portion 233 of the baffle 23 is still limited by the bolt 235 so that the baffle 23 returns to a tilted state. When the first and second grips 121, 131 of the clamping set 10 are released, the shaft 22 is immediately positioned by the axial aperture 231 of the baffle 23 and confined the first and second arms 12, 13 to open. On the other hand, in order to loosen the grip of the item, the press lever 24 is pressed again to release the shaft 22 to open the first and second arms 12, 13.

Figure 7:
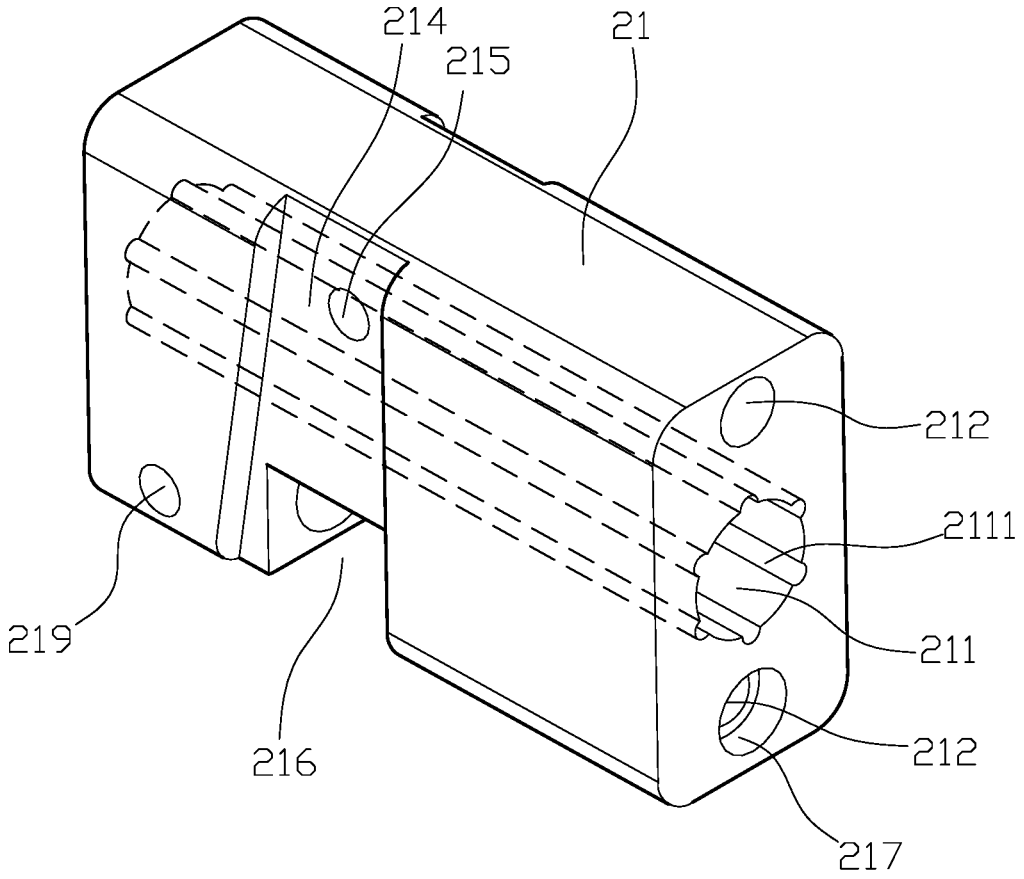
FIG. 7 is a schematic view showing a plurality of radical grooves of the shaft slot according to the preferred embodiment of the present invention.
Figure 8:
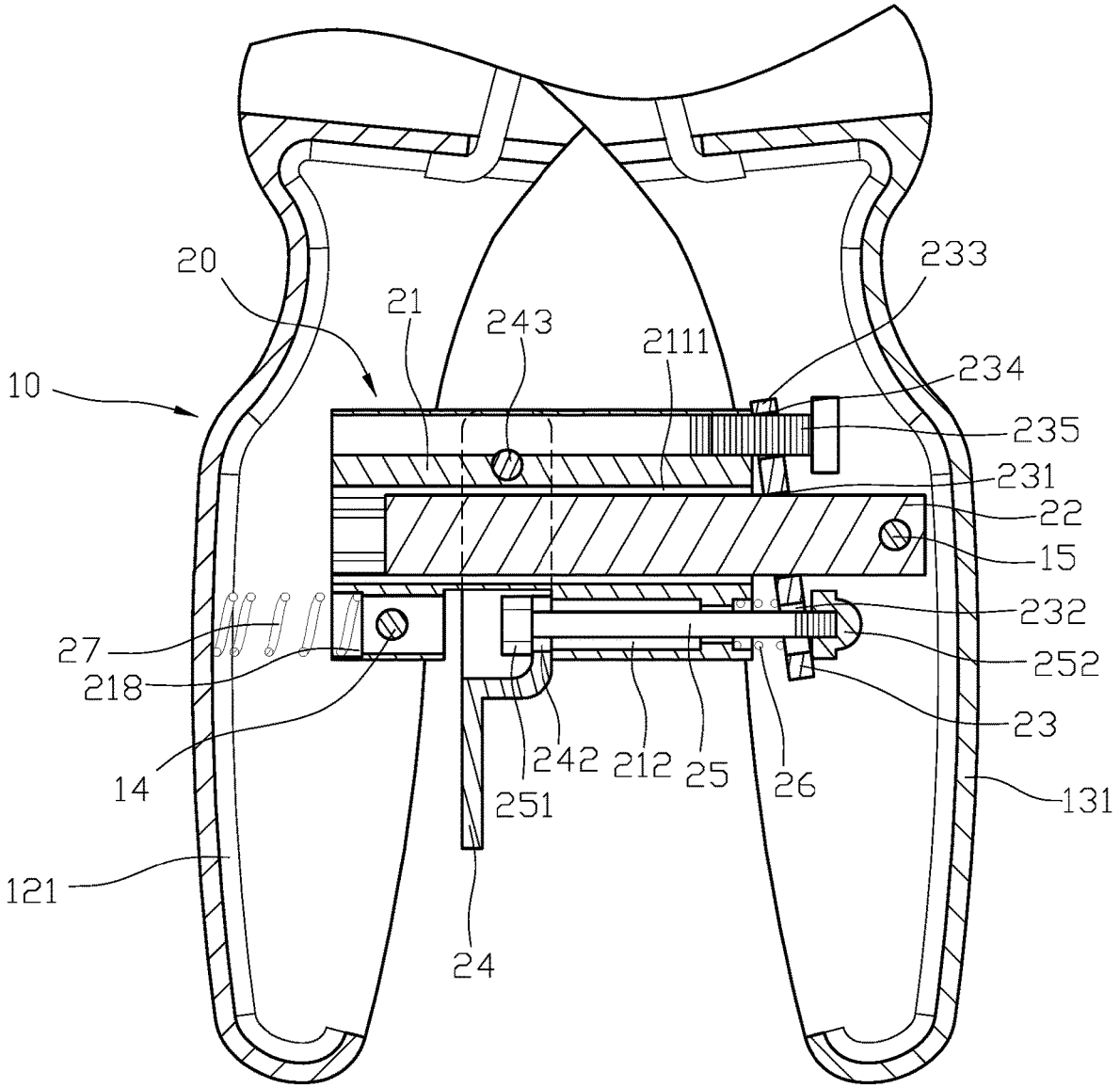
FIG. 8 is a cross-sectional view showing the plurality of radical grooves of the shaft slot according to the preferred embodiment of the present invention.

In addition, the shaft slot 211 of the main body 21 is further provided with a plurality of the radial grooves 2111, as shown in FIGS. 7, 8. Since the clamping set 10 is mostly applied to wood cutting and wood work, which causes huge amount of sawdust, the radial grooves 2111 discharge the sawdust to protect the shaft 22 in the shaft slot 211.

Figure 9:
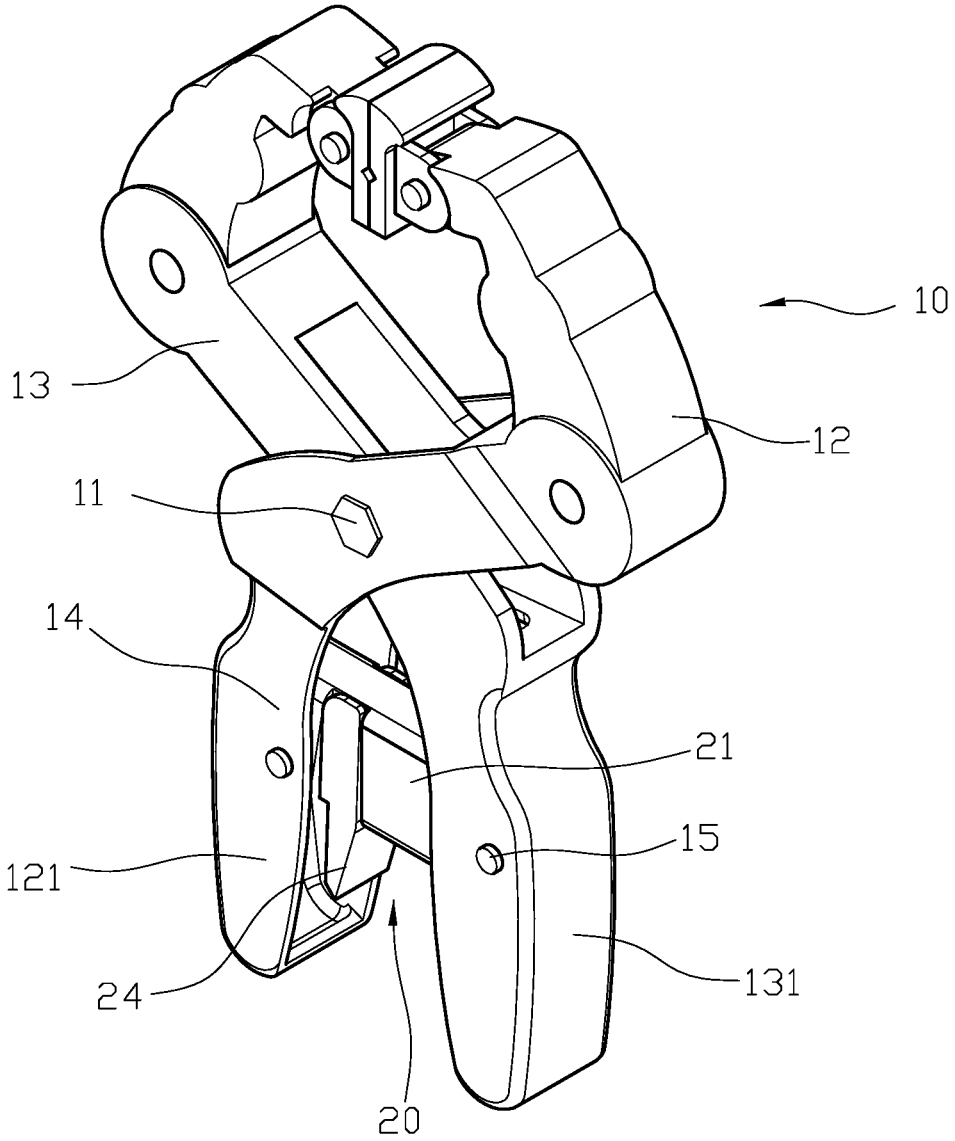
FIG. 9 is a perspective view of another embodiment of the present invention.
Figure 10:
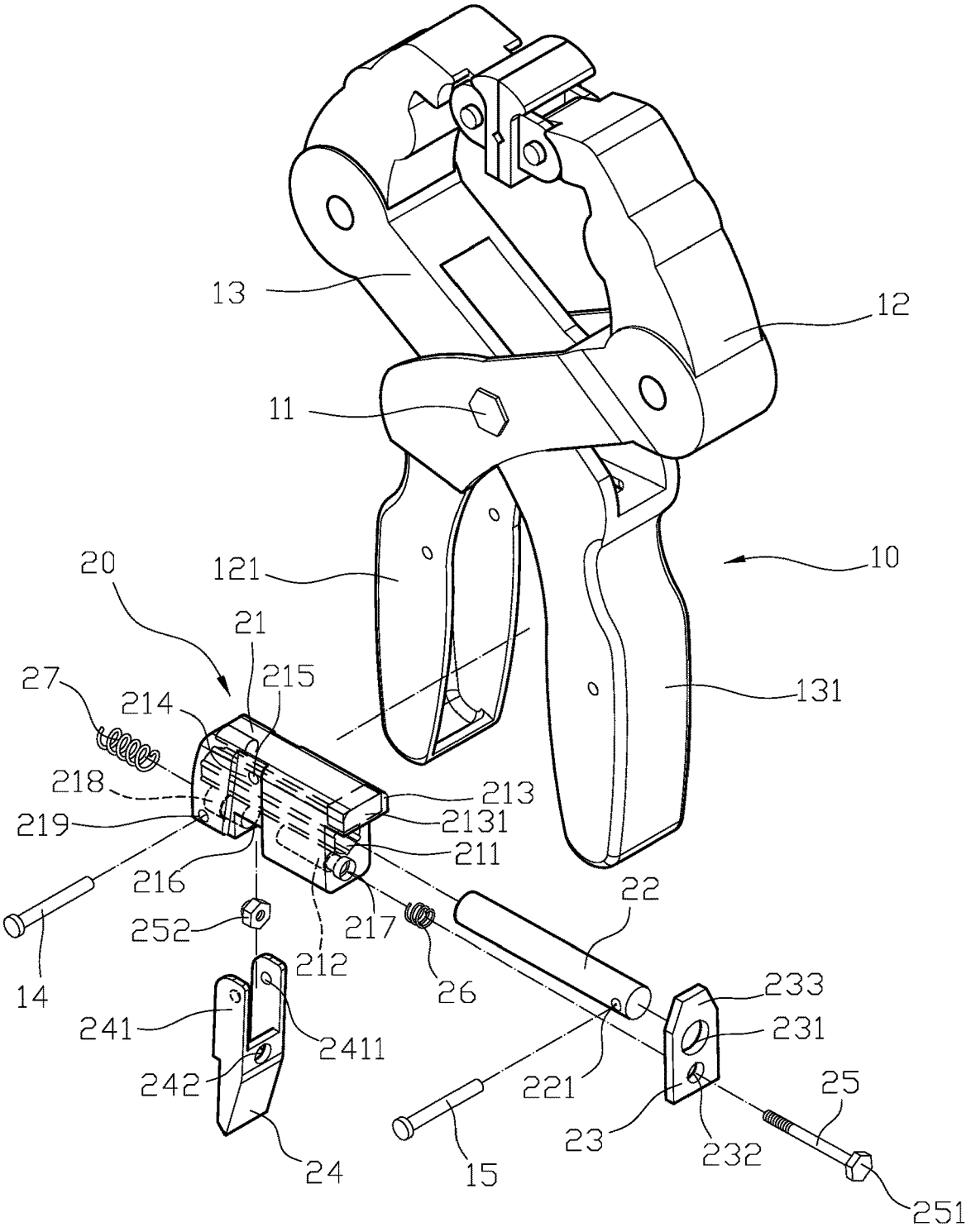
FIG. 10 is an exploded view of another embodiment of the present invention.
Figure 11:
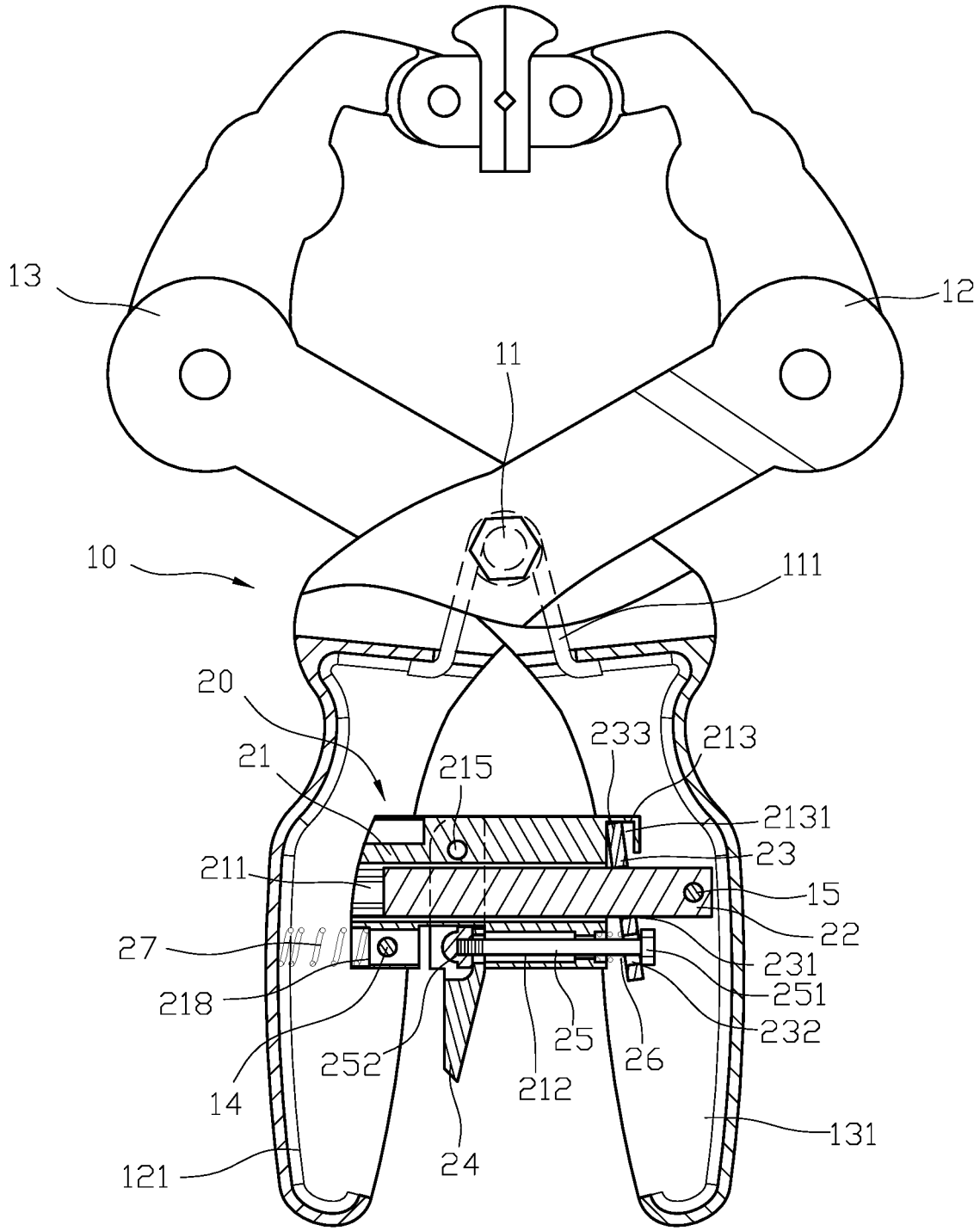
FIG. 11 is a cross-sectional view showing a combination of another embodiment of the present invention.

For the structure in another embodiment of, please refer to FIGS. 9, 10, and 11. The limiting portion 213 of the main body 21 protrudes from the front end of the main body 21 and has a limiting slot 2131, and the engaging portion 233 of the baffle 23 has a bevel surfaces on both sides and engages with the limiting slot 2131. In addition, the two arms 241 of the press lever 24 both respectively have a positioning bump 2411 facing each other, when the two arms 241 of the press lever 24 cover the conical concave surfaces 214 of the main body 21, the positioning bumps 2411 engage with the positioning apertures 215 of the conical concave surfaces 214 and provide a pivoting connection between the press lever 24 and the main body 21. Further, for another combination of the baffle 23 and the press lever 24, the control rod 25 passes through the accepting aperture 232 of the baffle 23, the first elastic member 26, the through slot 212 and the recess 216, the end 251 of the control rod 25 pushes against the baffle 23, and the other end of the control rod 25 passes through the connecting portion 242 of the press lever 24 and is locked with the connecting portion 242 by the nut 252. Therefore, the press lever 24 presses the baffle 23 to move towards the main body 21.

Figure 12:
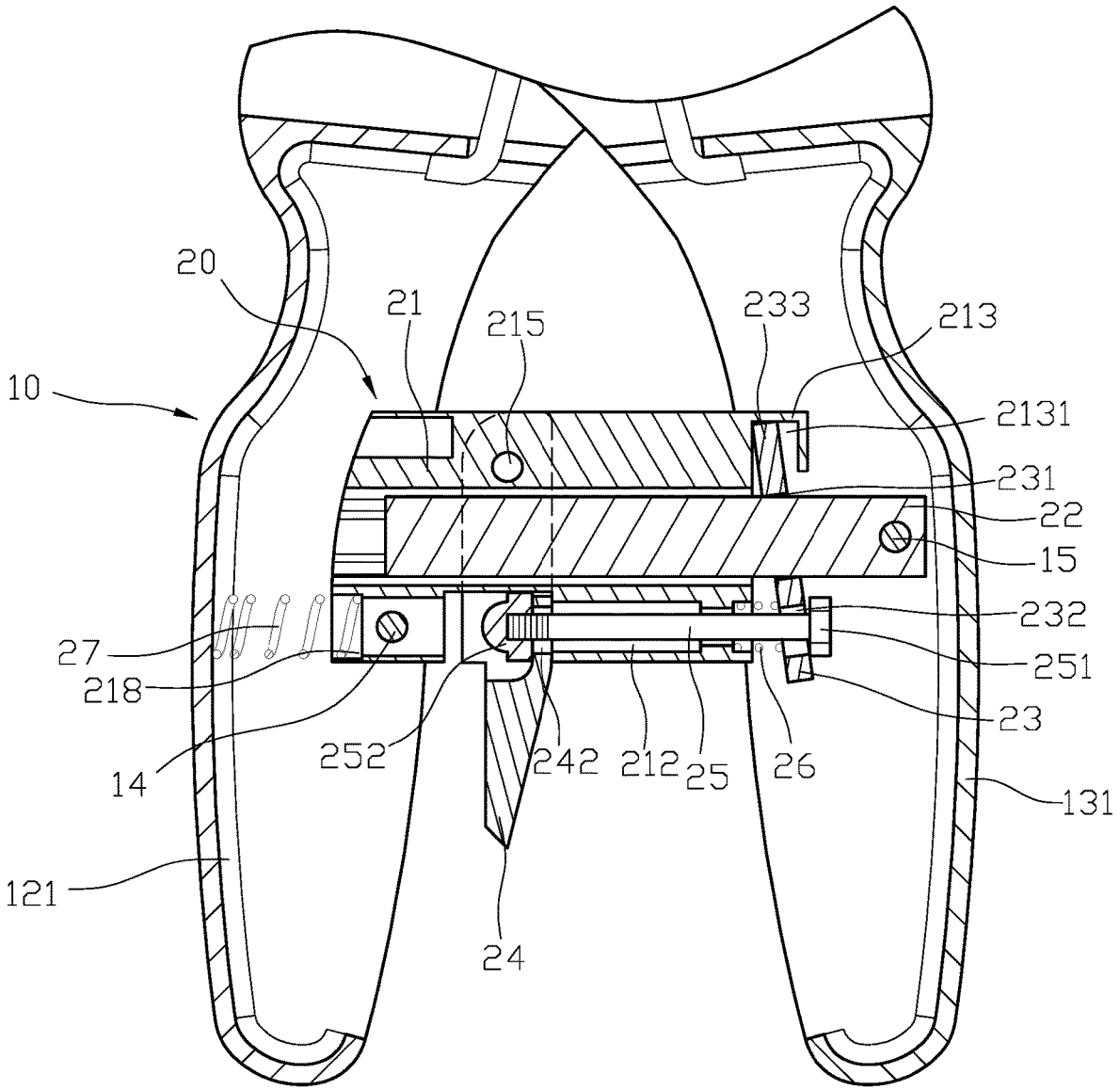
FIG. 12 is a cross-sectional enlarged view of another embodiment of the present invention.

For another embodiment of the present invention, please refer to in FIGS. 11 and 12. When the first and second arms 12, 13 of the clamping set 10 are closed, the baffle 23 of the positioning set 20 is positioned within the limiting slot 2131 and adjacent to the main body 21 due to the engaging portion 233, and the accepting aperture 232 at the lower end of the baffle 23 is kept away from the main body 21 by the first elastic member 26, thereby the baffle 23 is kept in a tilted state. Meanwhile, the axial aperture 231 of the baffle 23 locks to the shaft 22, so that the shaft 22 cannot be pulled out of the shaft slot 211 of the main body 21 and the elastic member 111 of the clamping set 10 is prevented from opening the first and second arms 12, 13, to achieve the closed positioning of the first and second arms 12, 13.

Figure 13:
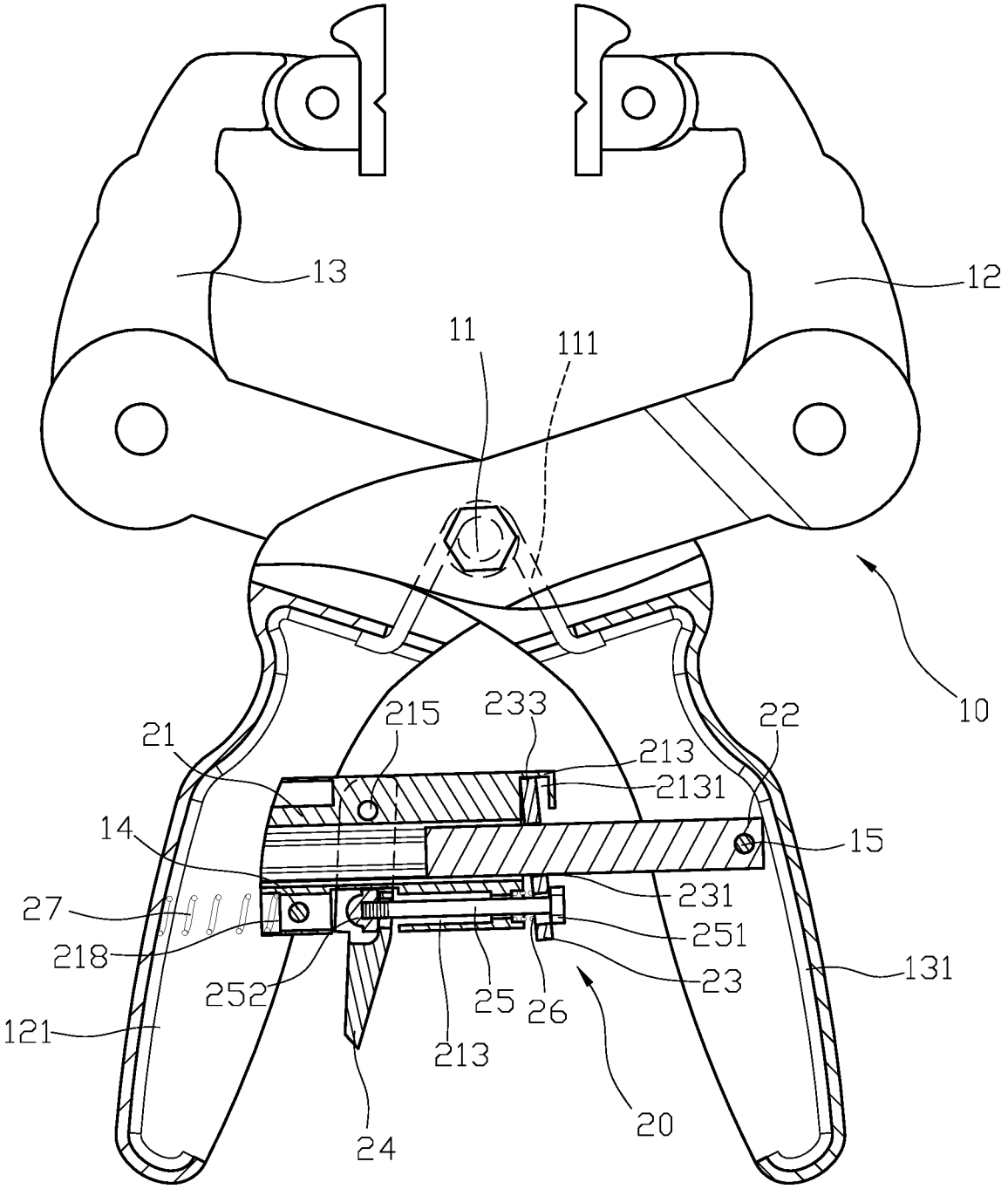
FIG. 13 is a schematic view showing the state of open of another embodiment of the present invention.
Figure 14:
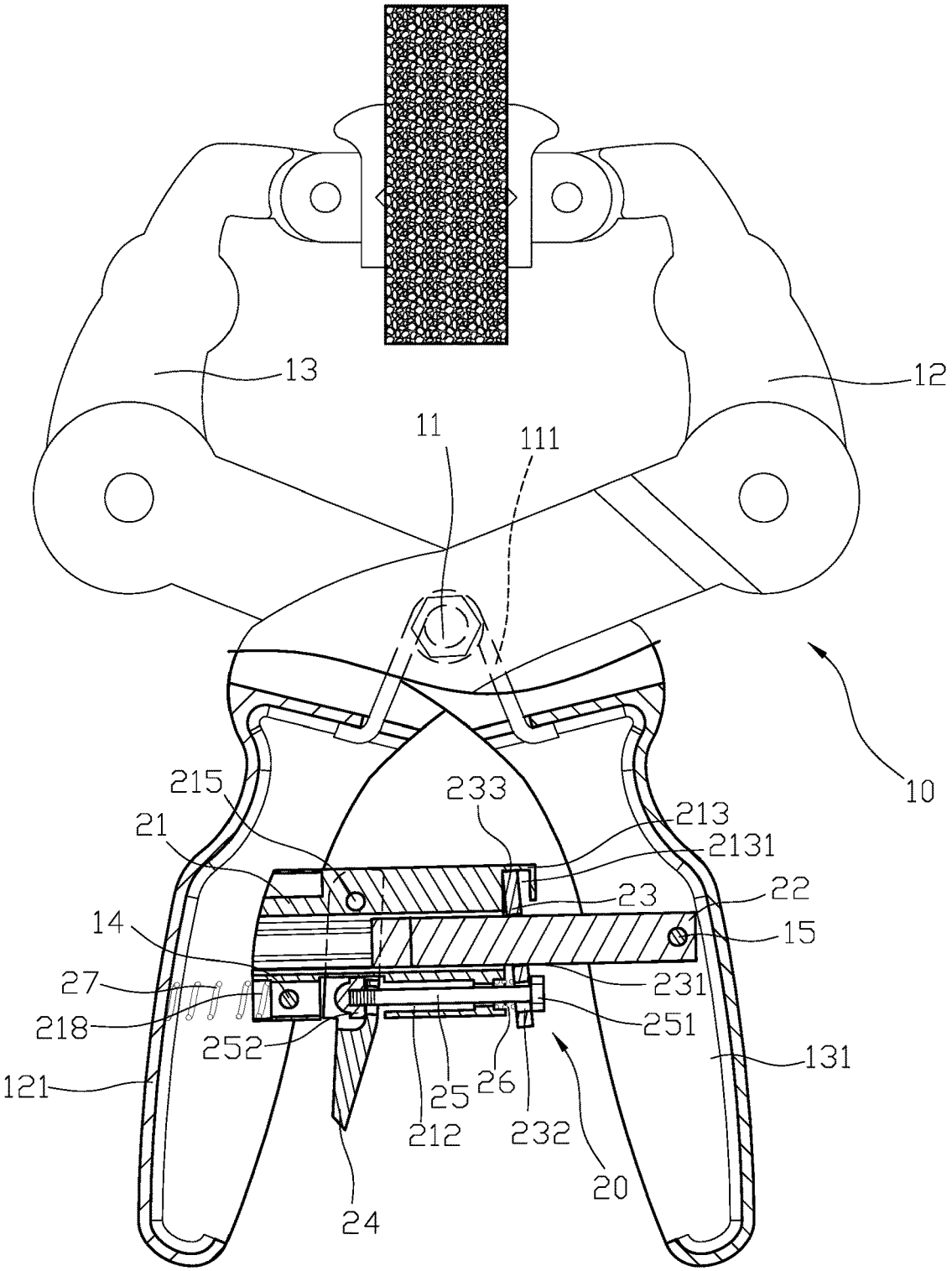
FIG. 14 is a schematic view showing a state of closing of another embodiment of the present invention.
Figure 15:
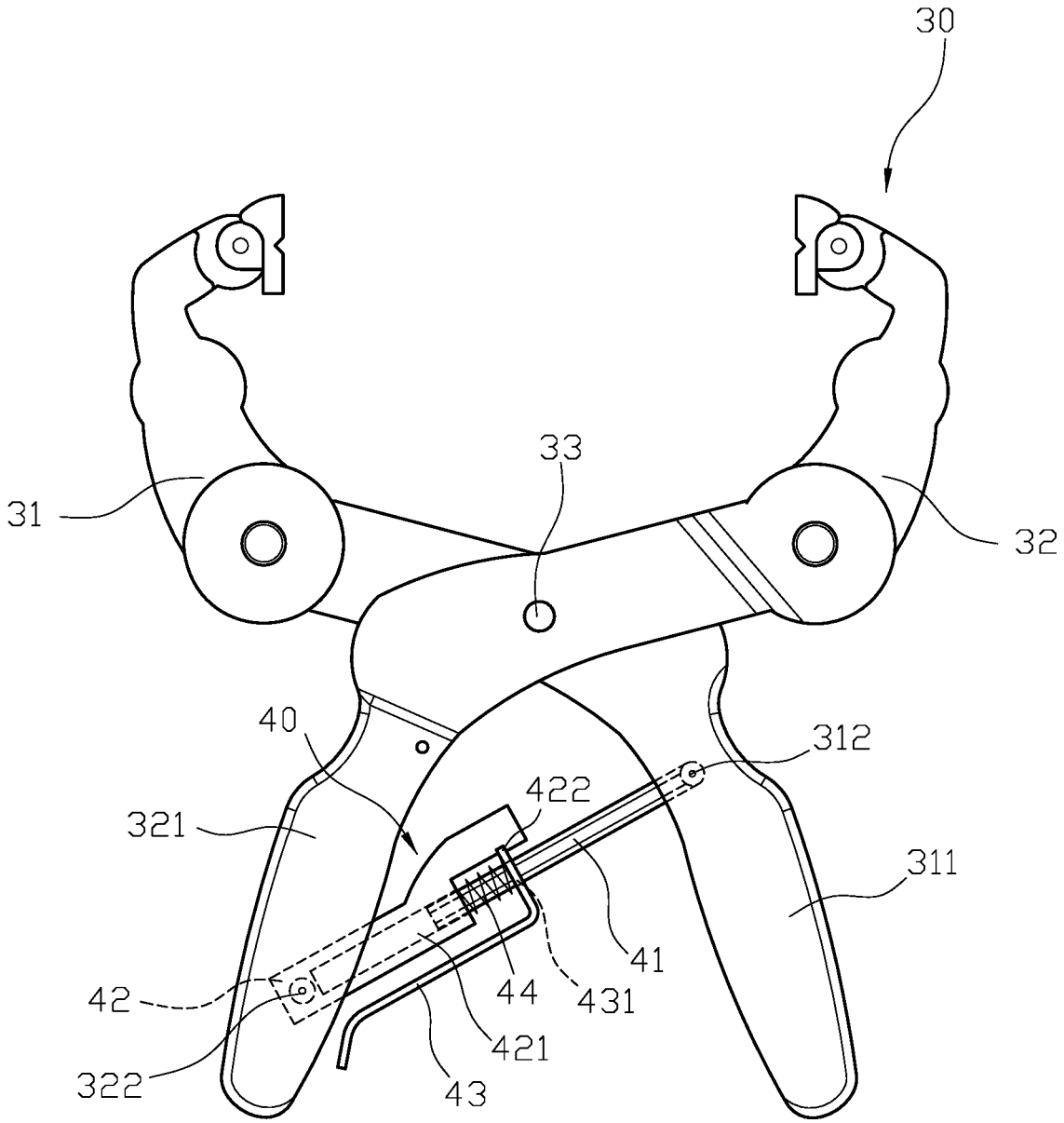
FIG. 15 PRIOR ART
FIG. 15 is a schematic diagram of the prior art.

In order to open the first and second arms 12, 13 of the clamping set 10, please refer to the FIGS. 13 and 14, the press lever 24 is pressed to drive the control rod 25 to move the baffle 23, so the lower end of the baffle 23 is pulled closer to the main body 21 and compressing the first elastic member 26, thereby the axial aperture 231 of the baffle 23 is slightly loosen from the shaft 22 and leaves the axial aperture 231 while the first and second arms 12, 13 being apart to form an opening state of the clamping set 10. After applying force on the first and second grips 121, 131 of the clamping set 10 to control the first and second arms 12, 13, the press lever 24 has been loosened, the lower end of the baffle 23 is immediately pushed away from the main body 21 by the first elastic member 26. Since the engaging portion 233 of the baffle 23 is continuously limited by the limiting slot 2131, the baffle 23 returns to a tilted state, by releasing the first and the two grips 121, 131 of the clamping set 10, the shaft 22 is immediately positioned by the axial aperture 231 of the baffle 23, which opens the first and second arms 12, 13 for clamping purpose. Alternatively, in order to loosen the grip, the press lever 24 is pressed to release the shaft 22, and then open the first and second arms 12, 13.

With the structure of the above specific embodiments, the following benefits can be obtained: the positioning set 20 is pivoted to the middle section of the first and second handles 121, 131 of the clamping set 10, so the moving stroke of the shaft 22 is reduced, which not only reduces the structural cost, but also effectively improves the movement of the shaft 22 and increases the convenience of operation.

In addition, the press lever 24 of the positioning set 20 is adjacent to the inside of the first handle 121, which can avoid the clamp from popping open by mistake and make the structure safer to use. Also it is convenient for the user to hold and release the clamp with one hand.

The control rod 25 has an end 251 and a nut 252 at the other end, which makes the combinations with the baffle 23 and the press lever 24 more convenient.

Although the present invention has been explained in relation to its preferred embodiment, it is to be understood that many other possible modifications and variations can be made without departing from the spirit and scope of invention as hereinafter claimed.

What is claimed is:

1. A clamp comprising:

a clamping set having a first arm and a second arm pivoted together via a first shaft, the first shaft jacketed with an elastic member configured to push the first arm and the second arm apart, the first and second arms respectively having a first handle and a second handle, the first handle provided with a first pin, the second handle provided with a second pin; and a positioning set having a main body, a second shaft, a baffle, a press lever and a control rod;

the main body comprising a shaft slot and a through slot below the shaft slot, the main body further having a limiting portion above the shaft slot and two opposing concave surfaces, a recess disposed between the two concave surfaces on the main body and intersecting the through slot;

the through slot comprising a first limiting opening at a front end for accepting a first elastic member and an assembly aperture at a rear end, the assembly aperture accepting the first pin engaged with the first handle;

the second shaft disposed through the shaft slot of the main body and having an engaging aperture accepting the second pin engaged with the second handle;

the baffle having an axial aperture, an accepting aperture below the axial aperture, and an engaging portion above the axial aperture, the axial aperture of the baffle jacketing onto the second shaft, the engaging portion and the limiting portion of the main body locked with each other, the accepting aperture facing the first limiting opening and the first elastic member;

the press lever having two arms and a connecting portion between the two arms, the two arms rotatably pivoted on the two concave surfaces of the main body, and the connecting portion disposed in the recess;

the control rod disposed in the through slot and the first limiting opening, one end of the control rod disposed in the recess and engaged with the connecting portion of the press lever, and another end of the control rod passing through the first limiting opening and connected to the accepting aperture of the baffle, such that the control rod drives the press lever and the baffle is pushed away from the main body by the first elastic member.

2. The clamp as claimed in claim 1, wherein the rear end of the through slot is further provided with a second limiting opening for accepting a second elastic member.

3. The clamp as claimed in claim 1, wherein the shaft slot of the main body further comprises a plurality of radial grooves.

4. The clamp as claimed in claim 1, wherein the two arms of the press lever are pivoted onto the main body with an axial pin.

5. The clamp as claimed in claim 1, wherein the two concave surfaces of the main body are connected by a positioning aperture, the two arms of the press lever both have a positioning bump, and an engagement of the positioning bump and the positioning aperture provides a pivot point for the press lever and the main body.

6. The clamp as claimed in claim 1, wherein the limiting portion of the main body is a screw hole, the engaging portion of the baffle has a limiting aperture corresponding to the screw hole, and a bolt is disposed through the limiting aperture and locked with the limiting portion to push the baffle.

7. The clamp as claimed in claim 1, wherein the limiting portion protrudes from the main body and has a limiting slot for accepting the engaging portion of the baffle.

* * * * *